United States Patent [19]

Stoeckli

[11] 4,388,847

[45] Jun. 21, 1983

[54] ENVELOPE OPENER

[76] Inventor: Oscar W. Stoeckli, 2 Hughes Ave., Rye, N.Y. 10580

[21] Appl. No.: 190,199

[22] Filed: Sep. 24, 1980

[51] Int. Cl.[3] ..... B26D 5/20

[52] U.S. Cl. ..... 83/356.3; 83/49; 83/595; 83/636; 83/694; 83/912

[58] Field of Search ..... 83/109, 167, 237, 249, 83/341, 356.3, 471, 481, 491, 508, 509, 595, 596, 636, 663, 671, 673, 674, 675, 692, 693, 694, 836, 839, 853, 854, 912, 916, 917, 42, 49; 30/240, 347; 407/117

[56] References Cited

U.S. PATENT DOCUMENTS

| | | | |
|---|---|---|---|
| 443,522 | 12/1890 | Hughes | 83/508 X |
| 1,167,999 | 1/1916 | Hendee | 83/167 |
| 1,408,415 | 2/1922 | Smith | 83/508 X |
| 1,786,959 | 12/1930 | Orr | 83/842 |
| 1,936,242 | 11/1933 | Orr | 83/842 |
| 3,301,116 | 1/1967 | Owen | 83/417 X |
| 3,677,117 | 7/1972 | Cutter | 83/167 X |
| 3,797,350 | 3/1974 | Orrick et al. | 83/912 X |
| 3,943,807 | 3/1976 | Bingham et al. | 83/912 X |

*Primary Examiner*—Harold D. Whitehead
*Assistant Examiner*—Robert P. Olszewski
*Attorney, Agent, or Firm*—St. Onge, Steward, Johnston & Reens

[57] ABSTRACT

Envelopes are opened by standing each envelope on an edge thereof in a guide channel and moving the envelope on edge along the channel into and through a cutting zone where one or more knives being rotated on a flywheel rotor continually move past an anvil and slice off a succession of narrow elongate segments of the border of the envelope. The segments are thrown from the cutter and fall by gravity into a collecting receptacle. Each knife has a cutting edge formed with at least one leading point and with cutting edge portions trailing from the point. Each segment is sliced off by first puncturing the envelope at a point in its border and then slicing it from that point across and along its edge.

20 Claims, 9 Drawing Figures

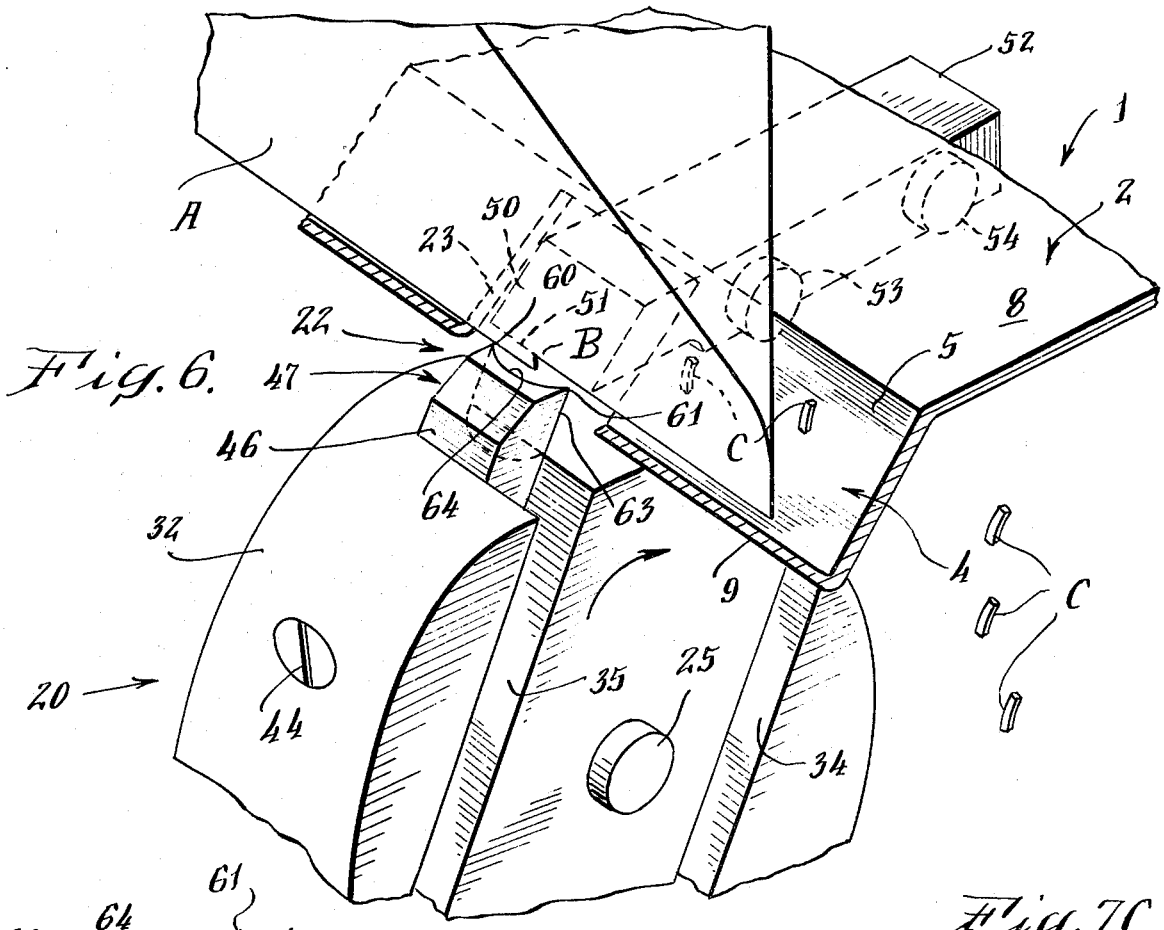
Fig. 6.
Fig. 7C.
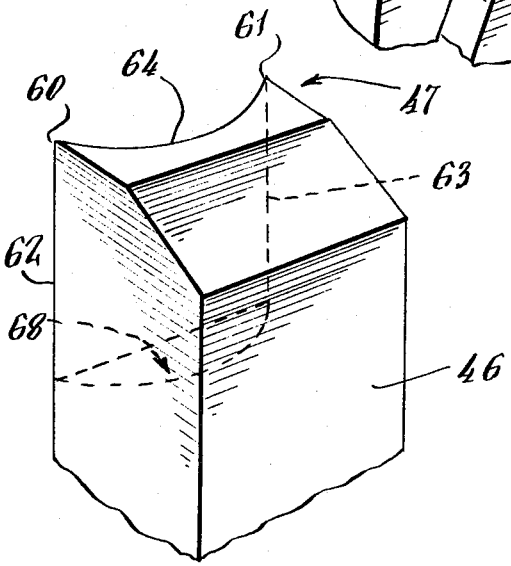
Fig. 7A.
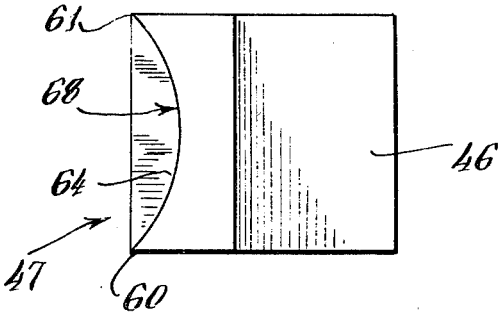
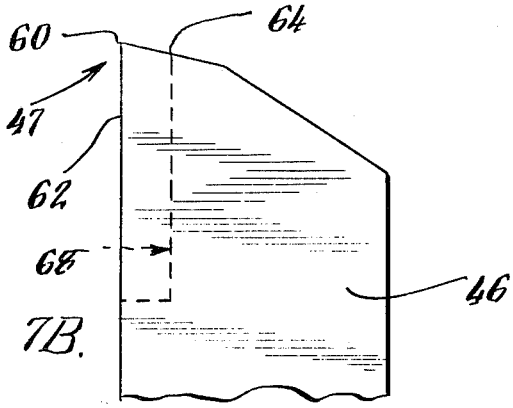
Fig. 7B.

ENVELOPE OPENER

This invention relates to an envelope opener and, more particularly, relates to an envelope opener which opens an envelope by slicing segments from a border of the envelope as it is moved past a rotating cutter.

Various forms of envelope openers which sever borders of the envelopes are known. For instance, U.S. Pat. No. 3,797,350 discloses an apparatus wherein a folded edge of an envelope is removed as the envelope is moved past a rotating circular saw element having a series of peripheral cutting teeth. The teeth are rotated past an anvil member presenting a generally horizontal edge to engage a side of the border of the envelope. An envelope stood upright on a folded edge is carried longitudinally between belts in a path crossing the path of the teeth so that bits of the envelope edge are sheared off as a sawdust which is blown out of the cutter housing by a motor-driven fan.

Such an envelope opening apparatus is disadvantageous in several respects, among which are that it requires a motor-driven belt system for feeding the envelopes and a fan and duct system for removing the sawdust formed by the cutter. Moreover, the saw wheel cutter and the fan are likely to be objectionably noisy in operation.

Other and simpler forms of envelope openers are known which typically involve laying each envelope flat on a feed surface and passing it along a lateral edge guide into and through a cutting zone where a continuous strip of the envelope border is sliced off. Such openers need to trim off as much as 0.06 inch of an envelope border in order to assure an opening cut; so there is considerable risk of damaging contents of the envelope.

SUMMARY OF THE INVENTION

It is an object of the present invention to provide a method and an apparatus with which envelopes are openable by simply standing each envelope on an edge thereof and moving it on edge through a cutting zone where the edge is removed by a multitude of successive slicing cuts. The invention thus enables removal of an envelope edge quickly and cleanly, and so easily that envelopes can be opened efficiently while being handled by unskilled workers. Further, only a relatively narrow border portion of the envelope, for instance one of about 0.03 inch in width, needs to be removed in order to obtain an opening cut; so there is little risk of damage to contents of an envelope in uses of the invention.

Further objects of the invention are to provide an envelope opener which is relatively quiet in operation; and one produces easily collected chips with substantially no dust; and one which is so compact and so light in weight that it can be easily carried about and is conveniently used or stored on a small area of a desk or table surface.

According to the method of this invention, envelopes are opened by passing an envelope stood on an edge thereof into and through a cutting zone along a path aligned with the envelope edge and in the cutting zone slicing off in succession with a rotating cutter a multitude of elongate segments of the envelope border along the edge until substantially the entire edge is removed. Each segment is sliced off by slicing through the border on cut lines extending across and along the envelope edge. Preferably, in each cutting step the border is first punctured at a point spaced slightly inward from the edge and then is sliced through on cut lines extending from the puncture point. Further, each slicing preferably is effected at firstly mainly across the envelope edge and then along it, as in this way the inertia of the border edge portion being acted upon by the cutter aids in assurng a clean slicing action.

The narrow elongated segments, or cutting chips, formed from the envelope border are sufficiently dense and large that they are thrown from the cutting zone when sliced off by the cutter and fall away from the cutting zone by gravity. Thus, the chips are easily collected in a receptacle space beneath the cutting zone, and substantially no dust is formed.

The method of the invention is particularly well suited for being carried out with the feeding of envelopes by hand into and through the cutting zone. For this purpose, each envelope to be opened is simply stood upright by hand on an edge thereof placed in the bottom of an upwardly open guide channel directed into and from the cutting zone and then is moved on edge by hand along the channel so as to guide the edge into the cutting zone and through it in a straight path aligned with the channel bottom.

An apparatus, or envelope opener, according to the invention comprises means for guiding an envelope stood and moved on an edge thereof along a path aligned with that edge into and through a cutting zone disposed across said path; an anvil member presenting in the cutting zone a surface having an edge to support a side of the envelope border at a location spaced slightly away from the envelope edge; a rotary cutter having mounted thereon at least one knife presenting a cutting edge which is rotatable by the cutter across the anvil edge from the other side of said border, so that each cutting edge coacts with the anvil member in a revolution of the cutter to slice off a narrow elongate segment of the envelope border on cut lines respectively extending across and along its edge; and means for rotating the cutter at a speed sufficient for the cutting edge or edges to remove substantially the entire envelope edge by slicing off such segments successively as the envelope is passed through the cutting zone.

Each cutting edge preferably has at least one end thereof formed with a leading point positioned to rotate in an arc spaced slightly inside the path of the envelope edge, for puncturing the border of the envelope, and with cutting edge portions which respectively extend substantially radially and substantially axially from the leading point and trail from it so as to pass across a plane containing the anvil surface at an angle thereto. In this way a clean slicing action through the envelope border is assured. This slicing action can be effected reliably along an envelope border at a distance of as little as 0.02 to 0.04 inch from its edge. Further, in a preferred embodiment the same slicing action is obtained with movement of an envelope in either direction through the cutting zone, by having each cutting edge of the rotary cutter formed with a leading point at each of two opposite ends thereof, each for puncturing the envelope border, and providing as the axially extending cutting edge portion a concavely sloped edge that extends between the two leading points and lies substantially entirely in an arcuate plane coaxial with the cutter.

According to another feature of the invention, the rotary cutter comprises a small relatively massive rotor acting as a flywheel. Thus, a momentum is established which tends to maintain the desired slicing speed of the cutting edge or edges and does so even when the different envelopes being opened differ greatly in stiffness or resistance to the slicing action. In preferred embodiments, the rotor is a relatively heavy, substantially cylindrical body having a plurality of the knives, or blades with cutting edges, mounted thereon so that it is substantially balanced about its axis of rotation. For instance, in an advantageous embodiment a substantially cylindrical rotor body is formed with two knife retaining cavities disposed symmetrically at opposite sides of its axis of rotation and has a knife mounted replaceably in each of the cavities and protruding from it to a cutting edge on an end portion of each knife, with the knives and the body substantially in dynamic balance.

According to another feature of the invention, the envelope opener comprises a housing containing the rotary cutter and the means for rotating the cutter, such as an electric motor carrying the cutter on its shaft, and the housing has a top member provided with an upwardly open guide channel which extends along the top member and constitutes means for guiding into and through the cutting zone an edge of an envelope stood upright in the channel by hand and moved on edge by hand along the bottom of the channel. The guide channel preferably is a precisely dimensioned groove of V-shaped cross section depressed in a sheet metal top wall of the housing. It preferably traverses substantially the entire length of the housing top, being interrupted only by an opening across its bottom and one side at a location between lengths of the channel where the cutting zone is located. The side walls of the V-shaped channel diverge sufficiently from its bottom to accommodate envelopes having contents of various thicknesses. Their divergence lets an edge of such envelopes be stood and guided in a definite path along the bottom of the channel, yet the side walls are sufficiently closely spaced apart at their top to prevent movement of an operator's finger between them into the cutting zone.

The housing of the envelope opener advantageously has separate chambers for the cutter and the motor, respectively, and is provided with a receptacle at the bottom of the cutter chamber to collect the segments of envelope borders which are sliced off by the cutter as chips and are thrown and fall by gravity into the receptacle. The receptacle preferably is formed as a drawer that is slidable from the housing for disposing of collected chips.

The guide channel provided according to the invention is advantageous further in that it facilitates use of the opener for opening rumpled envelopes. When a rumpled envelope is stood on edge in the V-shaped guide channel and pressed down into and along its bottom, rumples in the edge are substantially straightened so that the edge can be removed by the slicing action in the cutting zone.

The above mentioned and other objects, features and advantages of the invention will be further apparent from the accompanying drawings and the following detailed description of an illustrative, preferred embodiment of the invention.

BRIEF DESCRIPTION OF THE DRAWINGS

FIG. 6 is a schematic perspective view illustrating on an enlarged scale the cutting method employed in a preferred embodiment of the invention; and FIGS. 7A, 7B and 7C are respectively perspective, side elevational and top plan views of a preferred form of a knife provided for use in the envelope opener.

DETAILED DESCRIPTION

Figure 1:
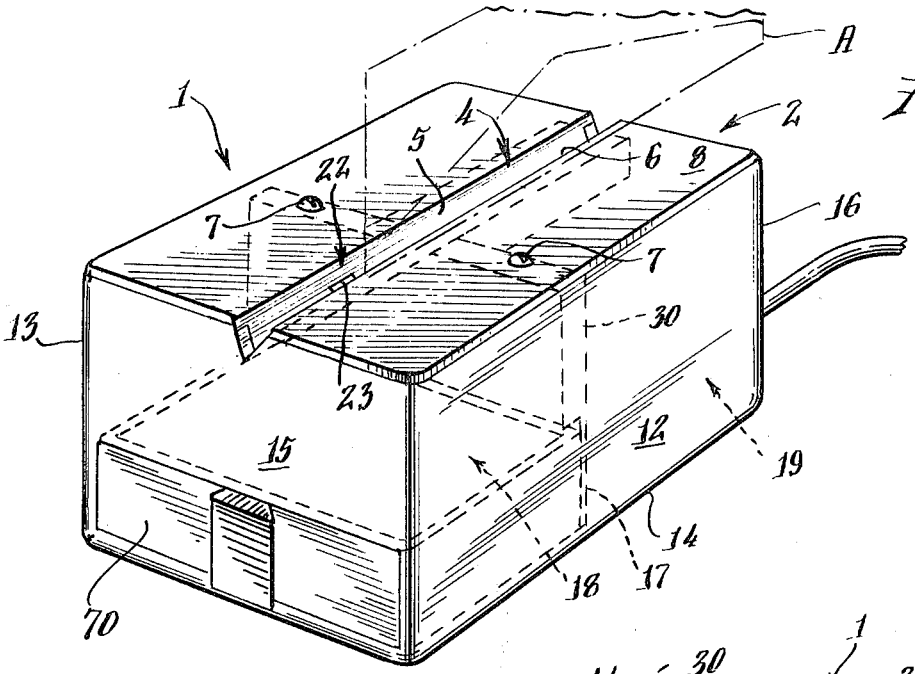
FIG. 1 is a perspective view of an envelope opener in accordance with the invention.
Figure 2:
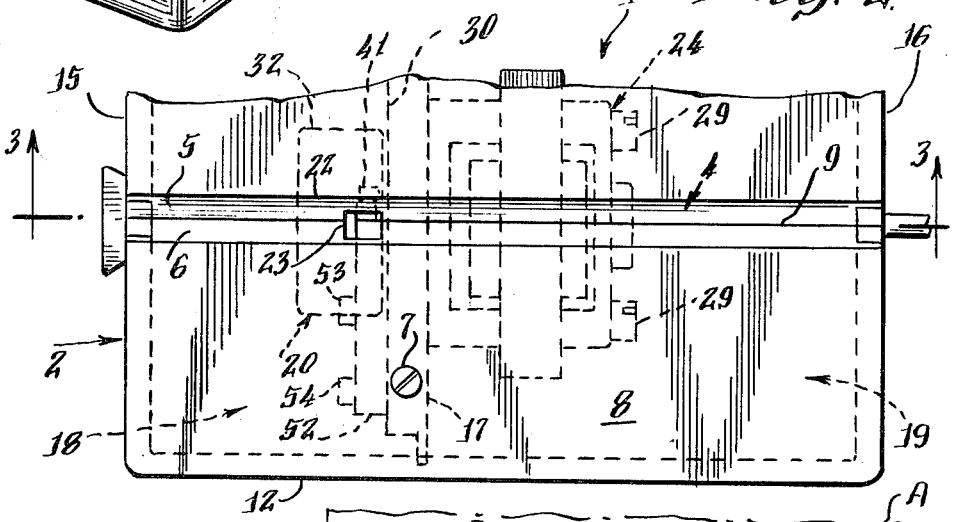
FIG. 2 is a partial top plan view thereof.
Figure 3:
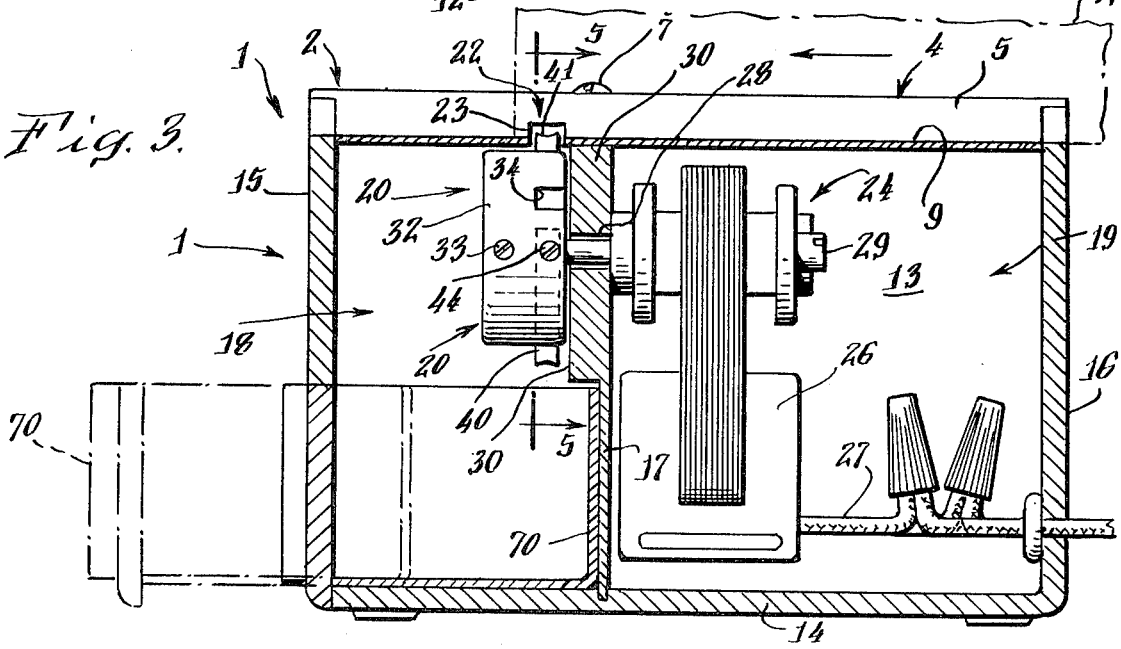
FIG. 3 is a sectional view thereof taken along the line 3—3 in FIG. 2.

Referring to FIGS. 1, 2 and 3 of the drawings, the envelope opener shown according to a preferred embodiment of the invention is encompassed in a housing 1 having a generally rectangular box shape and including a top member 2 provided with an upwardly open envelope guide channel 4 extending lengthwise thereof at its center. The housing 1 has side walls 12 and 13, a bottom wall 14 and end walls 15 and 16, all of which are preferably formed together as a unitary molding of a suitable plastic. These walls define a housing space that is divided by a partition, which preferably is a removable metal mounting plate 17, into two chambers 18 and 19. Chamber 18 contains a rotary cutter 20 which is operable to open an envelope by slicing off a multitude of successive narrow elongate segments of a border of the envelope in a cutting zone 22. Chamber 19 contains an electric motor 24 which drives the cutter 20, also a transformer 26 connected with electrical leads 27 for applying current to the rotor. The top member 2 preferably is removable for easy access to the interior of the housing.

A housing approximately six (6) inches long by approximately four (4) inches wide and approximately four (4) inches deep suffices for the purposes of this invention.

The rotary cutter 20 is mounted on the shaft 25 of the motor 24, which extends into the cutter chamber 18 through an opening 28 formed in the mounting plate, or partition, 17. The partition 17 has a thickened upper portion 30 to which the motor 24 is fastened by bolts 29. The top member 2 also is fastened to the upper portion 30, as by hold down screws 7. All the working parts of the envelope opener may be removed from the housing as a unit by removing the top member 2 with the partition 17 attached to it by the screws.

The top member 2 preferably is a unitary covering panel 3, or top wall, made of sheet metal, for instance of a chromium steel alloy sheet about 0.03 thick, and formed centrally with the guide channel 4 traversing its full length. The guide channel 4 is a depressed groove of V-shaped cross section formed to a precise depth along its bottom 9 and having upwardly divergent confronting side walls 5 and 6 which preferably diverge at an angle of about 60°. The side walls 5 and 6 are spaced apart sufficiently at the top of the channel 4, for instance by about 0.3 inch, to accept and position between them envelopes with contents of any ordinary thickness, yet so closely that a finger of a person using the envelope opener will not pass between them into the cutting zone at 22. The side walls and the bottom 9 of the guide channel extend evenly over the full length of the top panel 3, except at the location of the cutting zone 22 where the bottom 9 and side wall 5 are cut away to provide an opening 23 through the bottom portion of the channel about a part of the orbit of the cutting means carried by the cutter 20. The V-shaped guide channel thus provides at and along its bottom 9 a precisely positioned narrow apex surface for supporting and guiding an edge of an envelope stood upright in the channel. This apex surface guides the envelope edge in a precisely positioned path aligned with it as the envelope is moved on edge along the channel into and through the cutting zone at 22.

Figure 4:
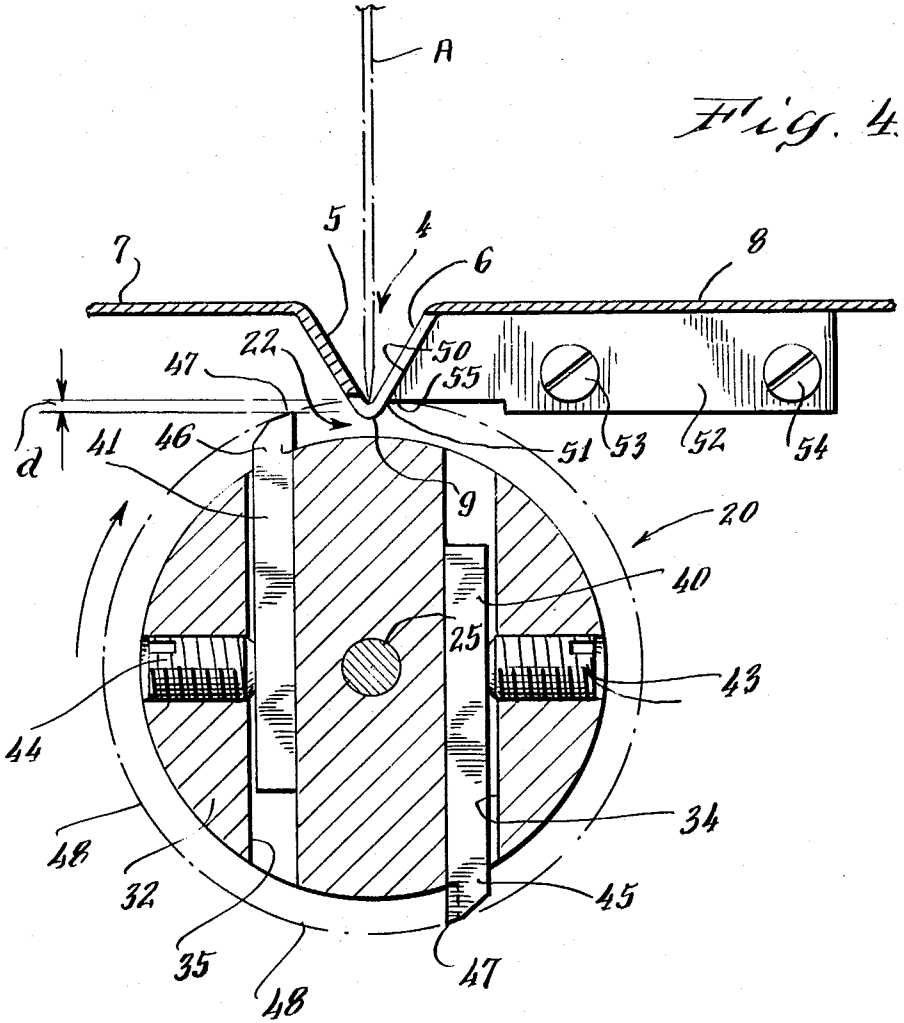
FIG. 4 is an enlarged transverse cross sectional view of the envelope opener, taken through the rotary cutter and the cutting zone along the line 5—5 in FIG. 3.
Figure 5:
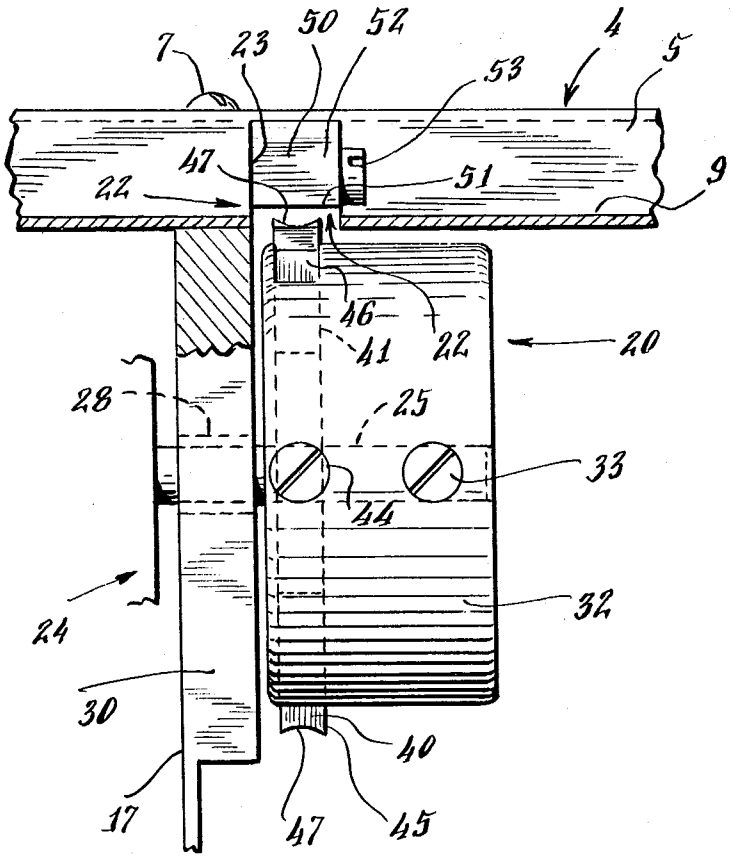
FIG. 5 is an enlarged longitudinal cross sectional view of the cutting zone.

The rotary cutter 20 (see FIGS. 3, 4 and 5) comprises a small though relatively massive cylindrical body 32 constituting a rotor which acts in operation as a flywheel. The rotor body 32 is fitted onto the motor shaft 25 and held fast to it, for instance by a set screw 33. One side of the body 32 has two knife retaining cavities 34 and 35 formed in it symmetrically at opposite sides of its axis of rotation. Especially formed knives 40 and 41 described more particularly below are mounted removably in these cavities. The cavities 34 and 35 as shown are substantially rectangular grooves extending as chords across the side of the rotor body, and the knives have body portions, or shanks, which fit into these grooves and are clamped in them, for instance by set screws 43 and 44, respectively. Respective end portions 45 and 46 of the knives protrude from the rotor body for rotation of a cutting edge 47 formed on each of these end portions in a fixed orbit as indicated by line 48 in FIG. 4. A suitable rotor body 32, for instance, has a diameter of about 1.5 inch, an axial width of about 0.75 inch, and a weight of about 60 grams with the knives in place. The components of the rotary cutter in the arrangement shown can readily be brought to a substantially dynamically balanced condition in which the rotation of the cutter at high speed is smooth and nearly noiseless.

The knives 40 and 41 of the cutter 20 are set in the rotor 32 so that the orbit 48 of the cutting edges 47 passes through the cutting zone 22 in opening 23 at a desired distance d (FIG. 4) above the bottom 9 of the the guide channel 4, so inside the path into the cutting zone of the edge of an envelope positioned on and guided along the channel bottom. The settings of the knives in the rotor cavities can be adjusted to provide the desired distance d. This distance corresponds to the maximum width of the border segments to be sliced off envelopes by use of the apparatus and, typically, amounts to about 0.02 and 0.04 inch or, preferably, about 0.03 inch.

The distance d also corresponds substantially to the depth of the space between the envelope edge path defined by the guide channel bottom 9 and the lower edge 51 of an anvil surface 50 provided in the guide channel opening 23 at the cutting zone. Surface 50 is formed on an end of a bar 52 fixed by bolts 53 and 54 to the upper portion 30 of the partition or mounting plate 17. The anvil surface 50 at edge 51 forms an acute angle with the underside 55 of the bar end. Surface 50 is positioned so that it serves in effect as an extension of the surface of side wall 6 of the V-shaped guide channel. Thus it provides backing support at one side of an envelope border portion being moved through the cutting zone while the cutting edges 47 are acting against the envelope border from its other side by being rotated across and quite close to the anvil edge 51 in clockwise direction as viewed in FIGS. 4 and 6. The edge 51 is formed as a substantially straight cutting edge lying parallel to the axis of the rotor 32 and as close as practicable to the orbit 48 of the cutting edges 47, and it is wider than the cutting edges; so the anvil edge 51 acts somewhat like a scissors blade in aid of the action of the cutting edges 47.

As shown in FIG. 6 and FIGS. 7A–7C, the cutting edge 47 on the protruding end portion of each cutter knife, for instance the knife end designated 46, is formed with leading points 60 and 61 at opposite ends of the edge 47 and with cutting edge portions 62, 63 and 64 which in use trail from these leading points so as to pass across the plane of an envelope border in the cutting zone at angles thereto, so also at angles to a plane aligned with the anvil surface 50. The the edge portion 62 and 63 are substantially straight. In use they extend mainly radially though somewhat backward from the leading points 60 and 61, respectively. The edge portion 64 is concavely sloped and extends between the leading points substantially axially though also largely backward near each of the points. Cutting edge portion 64 as shown has an arcuate form. It may also be substantially V-shaped. Preferably it forms an acute angle, e.g. of about 40°, at each of the leading points 60 and 61. In any case, the axially extending yet trailing cutting edge portion is formed on the knife end so that it will lie substantially entirely in an arcuate plane coaxial with the rotor 32 and thus will pass through the cutting zone with substantially all points on it at nearly the same distance from the path of the envelope edge being moved through the cutting zone in alignment with the guide channel bottom 9.

When the cutter 20 is being rotated as depicted schematically in FIG. 6 the leading points 60 and 61 of each cutting edge 47 pass through the cutting zone in arcs spaced slightly inside the path of an envelope edge aligned with the guide channel bottom. An envelope border portion then present in the cutting zone, such as portion B of envelope A in FIG. 6, is first punctured by one of the leading points at a location slightly inside the envelope edge and then is sliced from the puncture point across the along the envelope edge. The slicing is effected at first mainly across by the radially extending cutting edge portion 62 and 63 that trails from the puncturing leading point, and then along the envelope edge by the cutting edge portion 64 where it trails from the same leading point. Thus, a narrow elongate segment of the envelope border is sliced off the envelope. It is sliced off straight, or nearly so, along and inside the envelope edge.

As the envelope continues to be passed on edge into the cutting zone, the fast rotating cutting edge 47 continually punctures and slices through portions of the envelope border, thus slicing off a multitude of narrow elongate segments of the border in succession until substantially the entire edge of the envelope is removed. This cutting action is effected similarly with movement of the envelope border in either direction into the cutting zone. Leading point 60 is active in one direction of the movement, and leading point 61 in the other. It is apparent that, especially if the envelope opener is designed to open envelopes moved in only one direction through the cutting zone, the cutter knife or knives can be made with a cutting edge having a single leading point with radially and axially extending cutting edge portions trailing from the one point.

The border segments sliced off by the cutter knives are thrown from the cutting zone by the rotating knife ends in the form of chips indicated at C in FIG. 6. A recess 68 along the face of each knife end lets the chips move away from the cutting edge. The chips are sufficiently large and dense that they fall quickly by gravity and are collected in a receptacle space of chamber 18 beneath the rotary cutter 20. This space in the illustrated embodiment contains a chip receptacle 70 formed as a drawer that can be slid out of the housing 1 through its end wall 15 for convenient disposal of the collected chips.

The knives required for the rotary cutter 20 can be made from drill rod stock of square cross section. Each knife if desired can be formed with a cutting edge such as edge 47 at each of its ends, in which case a knife 40 or 41 having a worn cutting edge on its protruding end can be renewed in cutting action simply by being reversed in position in a knife cavity of the rotor.

It will be apparent that various forms and arrangements of one or more knife retaining cavities with a knife fixed in each cavity may be provided in a rotor body suitably for use according to the invention. Forms of the rotor carrying plural knives, such as the form shown, are, however, advantageous in that assembly of the rotary cutter with its parts substantially in dynamic balance is facilitated. This is important for smooth and noise-free rotation of the cutter. A rotor carrying at least two knives, each with a cutting edge on a protruding end portion for slicing open envelope borders, is also advantageous in that the envelope opening capacity at a given speed of rotation can be considerably greater than in the case of a rotor carrying a single knife. For instance, a rotary cutter having two cutting edges as shown will slice open up to 750 linear inches of envelope edge per minute at a rotor speed of 3000 r.p.m.; about half as much opening capacity would be provided with a single cutting edge at the same speed.

Although the envelope opener shown in the drawings is particularly advantageous in that it enables efficient opening of envelopes by simple hand operations, the method and the apparatus herein disclosed are also suitable or adaptable for use with known mechanical envelope feeders.

The invention is also adaptable for automatic activation of the cutter driving motor when an envelope is placed in position to be opened; for instance, a switch in a circuit to motor 24 can be actuated to start the motor by an envelope stood on edge in the guide channel 4.

The exact speed and power requirements of the motor used to drive the rotary cutter will depend on a variety of factors, including the weight of the rotary cutter and the width and the number of the cutting edges. In general, however, a very low power requirement is involved in the use of the invention. For instance, it has been found that an envelope opener as here shown, when provided with two knives formed for slicing off border segments about 0.15 inch long by 0.03 inch wide, functions efficiently when driven at a speed of about 3,000 r.p.m. or one in the range of about 2,500 to 3,500 r.p.m., and it can be so driven by an electric motor having a power rating of about 0.004 horsepower or even less.

Although a preferred embodiment of the invention has been illustrated and described herein in detail, it will be apparent that the invention can be used in varous other ways and forms and that is it not limited to particulars of the illustrative embodiment unless as so required for fair construction of the appended claims.

I claim:

1. An envelope opener comprising means for guiding an envelope moved on the edge thereof along a path aligned with said edge into and through a cutting zone disposed across said path; an anvil member presenting in said zone a surface having an edge to support a side of the envelope border at a location spaced slightly away from said envelope edge; a rotary cutter having mounted thereon at least one knife presenting a cutting edge rotatable by said cutter across said anvil edge from the other side of said border, each said cutting edge coacting with said anvil member in a revolution of said cutter to slice off a narrow elongate segment of said border in said zone, each said cutting edge having at least one leading point with cutting edge portions extending therefrom oriented so that said leading point first pierces the border of said envelope inward of the edge thereof than one of said extending cutting edge portions being oriented to slice said border on a cut line extending across the border and another of said extending cutting edge portions being oriented to slice the border on a cut line extending along said envelope edge; and means for rotating said cutter at a speed sufficient for said cutting edge or edges to remove substantially the entire envelope edge by slicing off such segments successively as the envelope is passed through said zone.

2. An envelope opener according to claim 1, each said cutting edge having at an end thereof a leading point positioned to rotate in an arc spaced slightly inside said path for puncturing said border, with said cutting edge portions respectively extending generally radially and axially from said leading point, and each cutting edge portion trailing from the leading point so as to pass through said cutting zone after the leading point, and with said axially extending cutting edge portion further being so oriented so as to be substantially equidistant from the edge of said anvil as the axially extending cutting edge portion slices through the envelope border at the cutting zone.

3. An envelope opener according to claim 2, each said cutting edge having a said leading point at each of two axially opposite ends thereof, said axially extending cutting edge portion being constituted by a concavely shaped edge extending between said points and lying substantially entirely in an arcuate plane coaxial with said cutter.

4. An envelope opener according to claim 2, said cutter comprising a small relatively massive rotor acting as a flywheel.

5. An envelope opener according to claim 4, said rotor being a substantially cylindrical body having knife retaining cavities therein at opposite sides of its axis of rotation and having a said knife mounted in each of said cavities, the knives and said body being dynamically balanced about said axis.

6. An envelope opener according to claim 1, 2, 3, or 4, comprising a housing containing said cutter and said means for rotating said cutter, said housing having a top member provided with an upwardly open guide channel of V-shaped cross section extending therealong, said channel constituting said envelope guiding means.

7. An envelope opener according to claim 6, said housing comprising a chamber containing said cutter and having a receptacle at its bottom to collect the chips formed by said cutter.

8. An envelope opener according to claim 7, said receptacle being a drawer slidable from said housing for disposing of collected chips.

9. An envelope opener according to claim 6, said V-shaped guide channel traversing substantially the entire length of said top member, said cutting zone being located between lengths of said channel in an opening across the bottom of said channel.

10. An envelope opener according to claim 9, the side walls of said channel at the top thereof being spaced apart sufficiently to accept between them envelopes having contents of various thicknesses yet being sufficiently closely spaced apart to prevent movement of an operator's finger between them into said cutting zone.

11. An envelope opener according to claim 6, said top member being a sheet metal panel having a central portion thereof depressed therealong into a smooth V-shaped groove constituting said guide channel, the bottom of said channel being precisely positioned to support an edge of an envelope and to guide it into said cutting zone in a rectilinear path spaced a predetermined small distance inside the orbit of said cutting edge.

12. An envelope opener according to claim 11, said distance being of about 0.02 to 0.04 inch.

13. In an envelope opener for opening envelopes by cutting the edge from a border of an envelope as it is moved past a cutter mounted for rotation about an axis generally parallel to the path of the envelope edge, the improvement comprising:

an anvil having an edge adjacent the path of the envelope, said anvil being shaped to support an envelope border on one side thereof; and a said cutter comprising a small relatively massive rotor acting as a flywheel and at least one knife mounted replaceably on and having an end portion projecting from the periphery of said rotor towards the anvil, said end portion having a cutting edge including at least one leading point for puncturing the border of the envelope inward of the edge thereof and comprising cutting edge portions extending from the leading point and coacting with said anvil, at least one of said extending cutting edge portions being oriented to cut across the border of the envelope with another of said extending cutting edge portions being oriented to trail from said leading point with an orientation so as to slice along said border at an angle thereto and slice off a narrow elongate segment of said border in a revolution of said rotor.

14. An envelope opener according to claim 13, said rotor being a substantially cylindrical body having knife retaining cavities therein at opposite sides of its axis of rotation and having a said knife mounted in each of said cavities, the knives and said body being dynamically balanced about said axis.

15. An envelope opener according to claim 13 or 14, each said cutting edge having two of said leading points, one at each of two axial ends thereof with respective cutting edge portions extending from said points, said cutting edge portions including a substantially axially extending concavely shaped edge extending between said points and lying substantially in an arcuate plane coaxial with said rotor.

16. An envelope opener comprising a housing having a top member provided with an upwardly open guide channel for guiding therealong into a path traversing a cutting zone a border of an envelope held upright and moved by hand on an edge thereof in said channel;

said top member being a panel having a central portion thereof depressed therealong into a smooth V-shaped groove constituting said guide channel, the bottom of said channel being positioned precisely on a line spaced a predetermined small distance inside said cutting zone, said cutting zone being located between lengths of said channel in an opening across the bottom of said channel;

an anvil member presenting in said zone a surface having a lower edge positioned to support a side of the envelope border in said zone;

a rotary cutter comprising a small, relatively massive cylindrical rotor acting as a flywheel and having knife retaining cavities therein at opposite sides of its axis of rotation with a knife mounted replaceably in each of said cavities, each said knife presenting a cutting edge rotatable by said rotor across said anvil edge from the other side of said border;

each said cutting edge having at each of two opposite ends thereof a leading point positioned to rotate in an arc passing slightly above said edge path for puncturing said border, and comprising cutting edge portions respectively extending substantially radially and substantially axially from each of said points and trailing therefrom so as to pass across a plane containing said anvil surface at an angle thereto, said axially extending edge portions being constituted by a concavely sloped edge extending between said points and lying substantially entirely in an arcuate plane coaxial with said rotor; whereby each said cutting edge in a revolution of said rotor will slice off a narrow elongate segment of said border in said zone on cut lines respectively extending across and along said envelope edge;

and means including a rotary electric motor carrying said rotor on the motor shaft for rotating said cutter at a speed sufficient for said cutting edges to remove substantially the entire envelope edge by slicing off segments thereof successively as the envelope is passed by hand through said zone.

17. An envelope opener according to claim 16, said housing comprising a chamber containing said cutter, a chamber containing said motor, a partition between said chambers, said motor shaft extending through an opening in said partition, and a removable receptacle at the bottom of the cutter chamber for collecting the chips formed by said cutter.

18. The method of opening envelopes which comprises passing an envelope stood on an edge thereof along a path aligned with said edge into and through a cutting zone disposed across said path, and as the envelope is being passed through said zone slicing off with a rotating cutter a multitude of narrow elongate segments of the envelope border along said edge in succession until substantially the entire edge is removed, each of said segments being sliced off by puncturing said border at a point slightly away from said edge and then slicing through said border on cut lines respectively extending from said point across and along said edge.

19. A method according to claim 18, each of said segments being sliced off by slicing said border at first mainly across and then along said edge.

20. A method according to claim 18, comprising standing the envelope upright by hand on an edge thereof placed in the bottom of an upwardly open guide channel directed into and from said zone and moving the envelope on edge by hand along said channel so as to guide said edge into said zone in a straight path aligned with said bottom.

* * * * *